US005515807A

United States Patent [19]

Speer et al.

[11] Patent Number: 5,515,807

[45] Date of Patent: May 14, 1996

[54] ONE-WAY ROADWAY MARKER

[75] Inventors: Peter A. Speer, Kirkland; Harry J. Glutting, Tacoma; Michael W. Sly, Kent, all of Wash.

[73] Assignee: Davidson Plastics Corporation, Kent, Wash.

[21] Appl. No.: 371,473

[22] Filed: Jan. 10, 1995

Related U.S. Application Data

[63] Continuation of Ser. No. 50,919, Apr. 20, 1993, abandoned, which is a continuation-in-part of Ser. No. 735,321, Jul. 24, 1991, Pat. No. 5,327,850, which is a continuation-in-part of Ser. No. 694,873, May 2, 1991, abandoned.

[51] Int. Cl.[6] ..... E01F 9/047; G08B 7/00

[52] U.S. Cl. ..... 116/63 R; 404/16

[58] Field of Search ..... 116/63 R, 63 P, 116/DIG. 16; 404/9, 12, 14, 15, 16

[56] References Cited

U.S. PATENT DOCUMENTS

| | | | |
|---|---|---|---|
| 1,707,432 | 4/1929 | Erickson . | |
| 1,830,319 | 11/1931 | Hartzler et al. | 404/15 X |
| 2,208,080 | 7/1940 | Overdorff | 404/15 X |
| 2,664,065 | 12/1953 | Thompson | 116/63 |
| 3,179,009 | 4/1965 | Sheffield et al. | 404/16 |
| 3,240,132 | 3/1966 | Wiswell | 404/16 |
| 3,277,800 | 10/1966 | Wiswell | 94/1.5 |
| 3,319,542 | 5/1967 | Bergsnov-Hansen | 94/1.5 |
| 3,332,327 | 7/1967 | Heenan | 94/1.5 |
| 3,392,639 | 7/1968 | Heenan et al. | 404/12 |
| 3,478,714 | 11/1969 | Keats | 116/63 P |
| 3,588,222 | 6/1971 | Julius | 350/100 |
| 3,924,958 | 12/1975 | Rowland | 404/15 |
| 3,936,208 | 2/1976 | Baynes et al. | 404/16 |
| 3,938,903 | 2/1976 | Montgomery | 404/16 |
| 4,008,973 | 2/1977 | Montigny | 404/16 |
| 4,234,265 | 11/1980 | Otis | 404/16 |
| 4,340,319 | 7/1982 | Johnson, Jr. et al. | 404/16 |
| 4,428,320 | 1/1984 | Oplt et al. | 116/63 R |
| 4,521,129 | 6/1985 | Krech et al. | 404/10 |
| 4,557,624 | 12/1985 | Walker | 404/14 |
| 4,588,258 | 5/1986 | Hoopman | 350/103 |
| 4,726,706 | 2/1988 | Attar | 404/14 |
| 4,875,798 | 10/1989 | May | 404/12 |

FOREIGN PATENT DOCUMENTS

| | | | |
|---|---|---|---|
| 2020221 | 11/1971 | Germany | 404/16 |
| 2900481 | 7/1980 | Germany | 404/16 |
| 2903215 | 7/1980 | Germany | 404/16 |

*Primary Examiner*—William A. Cuchlinski, Jr.
*Assistant Examiner*—John L. Beres
*Attorney, Agent, or Firm*—Christensen, O'Connor, Johnson & Kindness

[57] ABSTRACT

An extrudable one-way roadway marker (11) is provided having enhanced stability. The roadway marker has a constant cross section along a centerline (A—A) that allows the roadway marker to be manufactured by extrusion. The base (13) of the roadway marker has a series of adjacent parallel grooves (19) that provide a large adhesive surface. A downwardly extending gripping edge (14) assists in attaching the roadway marker to a roadway surface. An inclined surface (23) of the one-way roadway marker receives a reflective tape strip (31) that is protected by a lip (29) lying along the upper edge of the inclined surface. A raised rumble portion (15) provides a physical rumbling cue. The parallel grooves form sharp teeth (21) where they join. The sharp teeth project away from the inclined surface of the roadway marker.

18 Claims, 1 Drawing Sheet

ONE-WAY ROADWAY MARKER

CROSS-REFERENCE TO RELATED APPLICATION

This application is a continuation application based on prior application Ser. No. 08/050,919, filed on Apr. 20, 1993, entitled One-Way Roadway Marker, now abandoned, which is a continuation-in-part of U.S. patent application Ser. No. 07/735,321, filed Jul. 24, 1991, entitled Roadway Marker, now U.S. Pat. No. 5,327,850 which, in turn, is a continuation-in-part of U.S. patent application Ser. No. 07/694,873, filed May 2, 1991, also entitled Roadway Marker, now abandoned, all of which are incorporated herein by reference.

TECHNICAL AREA OF THE INVENTION

This invention relates to roadway markers and, more particularly, to low-profile, extrudable, lightweight roadway markers having enhanced stability.

BACKGROUND OF THE INVENTION

Roadway markers are utilized in a variety of traffic control applications. Many roadway markers are permanently affixed to a roadway to delineate lanes of traffic on the roadway. Other roadway markers are used to temporarily delineate construction or work areas. Roadway markers used in such applications are called temporary roadway markers. Both permanent and temporary roadway markers are attached to a roadway with a suitable adhesive.

Permanent roadway markers have a low profile and remain in place to define traffic lanes, identify obstacles and perform other well-known functions. While having a low profile, many permanent roadway markers are raised to create a rumble sound in an automobile when the tires of the automobile impact a row of markers. The most commonly used permanent roadway marker is formed of ceramic and has a partially hemispherical, button-like shape. In recent years, alternative roadway markers having inclined surfaces covered with a retroreflective medium in the form of a surface tape or embedded prisms have been developed for use as permanent roadway markers.

Temporary roadway markers serve to notify motorists that a construction area is near and that caution is needed. They often direct roadway traffic to pass along the portions of the roadway unaffected by construction, while protecting workers within a construction area from roadway traffic. After construction is completed, temporary roadway markers are loosened and removed. To be effective temporary roadway markers must alert traffic of the construction area. Typically, temporary roadway markers warn oncoming motorists by the use of visual cues, such as reflective surfaces. Some temporary roadway markers also use physical cues such as causing a vehicle to create a rumbling noise on contact with a marker.

As noted above, both permanent and temporary roadway markers that provide visual cues often have a reflective surface that reflects light back to a driver. Physical cues are provided by a raised portion that causes the automobile to rumble upon contact with the marker. One example of a roadway marker that provides both visual and physical cues is described in U.S. Pat. No. 4,428,320, issued to Oplt et al. and entitled "Reflective Paving Marker." The Oplt et al. patent describes a roadway marker having a generally trapezoidal prism shape with a honeycombed interior, a reflective surface and raised areas. The honeycombed interior makes the marker lightweight, which is desirable. Although the roadway marker is lightweight, one disadvantage of the Oplt et al. roadway marker is its high manufacturing cost. Due to its construction, the Oplt et al. roadway marker must be injection molded. Injection molding is expensive when compared to other manufacturing processes such as extrusion. Many prior art roadway markers share these same disadvantages because they can only be formed by injection or some other molding processes.

In order to overcome the costs disadvantage associated with injection molding, roadway markers having a constant cross-sectional shape along their longitudinal axis have been developed. The constant cross-sectional shape allows such roadway markers to be made by an inexpensive extrusion manufacturing process. Such roadway markers are described in parent U.S. patent applications Ser. Nos. 07/735,321 and 07/694,873 more fully referenced above, the subject matter of which applications is incorporated herein by reference.

In addition to their constant cross-sectional shape, roadway markers of the type described in the foregoing patent applications include a base area suitable for adhesive attachment to a roadway surface, as well as a raised rumble portion. The base area of the marker is relatively large and includes a plurality of adjacent, parallel grooves of arcuate cross section. The arcuate grooves increase the adhesive surface of the marker. The longitudinal lower edges of the base curve downwardly to assist in gripping the roadway surface. The top of the raised rumble portion is scalloped to reduce the weight of the roadway marker. The longitudinal lateral sides of the raised rumble portion of the roadway marker include a recess for receiving a strip of reflective tape. The two orthogonal sides are sheared straight, or inclined, depending upon the intended use of the marker. Alternatively, rather than the lateral sides including recesses for receiving a strip of reflective tape, the lateral sides may be inclined toward the scalloped top.

While extruded roadway markers of the type described above have a number of advantages over previously developed roadway markers of the ceramic or injection molded types, previously developed extruded roadway markers of the type described in the foregoing U.S. patent applications, like many previously developed injection molded roadway markers, are bidirectional. That is, they are generally square-shaped and include two faces with a reflective medium. As a result, while such markers can be used in environments where traffic is coming from only one direction and, thus, bidirectional viewability is not required, the use of such markers in this environment is somewhat undesirable due to the costs associated with producing a bidirectional marker. These costs include more material than necessary and the expense associated with creating two reflective faces when only one is needed.

The present invention is directed toward providing lightweight, low-cost roadway markers that provide a physical rumbling cue and a visual (reflective) cue that overcome the foregoing disadvantages while retaining a constant cross-sectional shape throughout their length that allows them to be made by inexpensive extrusion manufacturing processes.

SUMMARY OF THE INVENTION

In accordance with this invention, an extruded roadway marker is provided. The marker has a constant cross-sectional shape, which includes a base area suitable for adhesive connection to a roadway surface, and a raised rumble portion. The base area of the marker has a plurality of adjacent parallel grooves of arcuate cross section. The bottom of one of the parallel sides of the base (the trailing side) curves downwardly to assist in gripping the roadway when the other parallel side is impacted by a vehicle tire. The other parallel side (the leading side) includes an inclined surface. A strip of reflective tape is mounted on the inclined surface.

In accordance with other aspects of this invention, the inclined surface of the roadway marker includes a recess for receiving the strip of reflective tape.

In accordance with still further aspects of this invention, the inclined surface terminates at a ridge. The surface between the ridge top and the trailing side has a concave shape.

In accordance with further aspects of this invention, the teeth formed by the adjacent parallel grooves are sharp and project away from the leading side of the roadway marker. The thusly formed teeth tend to dig into the attaching adhesive and underlying road surface when the leading side of the roadway marker is impacted by a vehicle tire.

BRIEF DESCRIPTION OF THE DRAWINGS

The foregoing and other advantages and features of this invention will become better understood by reference to the following description of a preferred embodiment of the invention when taken in conjunction with the accompanying drawings, wherein.

DESCRIPTION OF THE PREFERRED EMBODIMENTS

Figure 1:
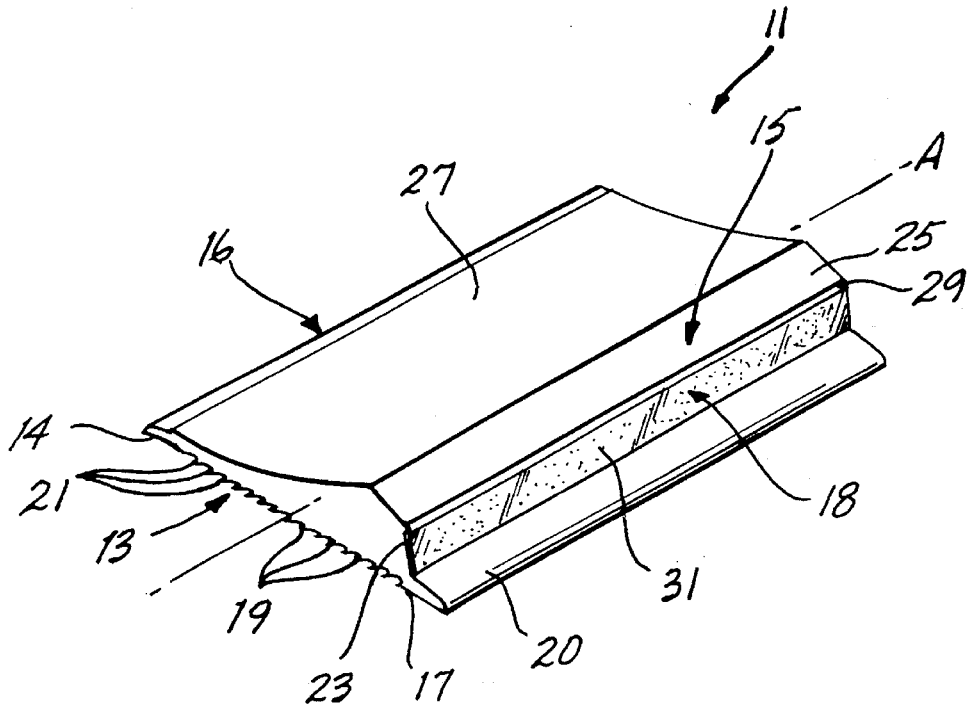
FIG. 1 is an isometric view of a roadway marker formed in accordance with the present invention.
Figure 2:
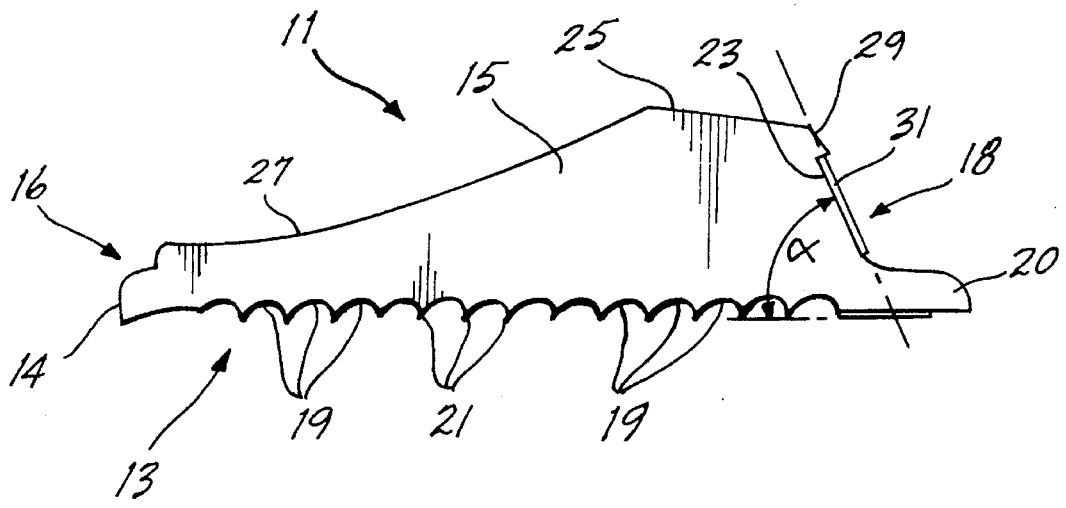
FIG. 2 is an end view of the roadway marker of FIG. 1.

As shown in FIGS. 1 and 2, a roadway marker 11 formed in accordance with this invention is one integral piece having a constant cross section from one end to the other along a longitudinal centerline A—A. The constant cross section allows the marker to be extruded and sheared to any desired length. The roadway marker 11 illustrated in FIGS. 1 and 2 has a base area 13 and a raised rumble portion 15. The base area 13 is substantially planar and of rectangular shape. The large base area allows the roadway marker to be strongly attached to a roadway surface by any suitable adhesive, such as epoxy, butyl, or hot melt. A gripping edge 14 located at the bottom of one of the parallel sides (the trailing side 16) curves downwardly from one of the parallel longitudinal edges of the base area 13. A wing 20, having a somewhat flatter bottom, lies along the base of the other parallel side (the leading side 18) of the roadway marker 11. The downward curvature of the gripping edge 14 provides enhanced gripping of a roadway surface. More specifically, when an automobile tire impacts the roadway marker 11 along the leading edge and creates a force generally orthogonally to the longitudinal centerline A—A, the force tends to cause the gripping edge 14 to dig into the roadway surface. Thus, the gripping edge 14 facilitates the stability of the roadway marker 11.

As shown best in FIG. 2, the base area 13 includes a series of parallel grooves 19. The grooves 19 are disposed adjacent and parallel one another. The grooves 19 are also parallel to the longitudinal centerline A—A. The grooves 19 extend the entire length of the marker 11 and have an arcuate cross section. The arcuate cross section increases the adhesion area of the base 13. The larger adhesion area allows the base to be better attached to a roadway. Arcuate grooves provide a larger surface area for adhesive than do the V-shaped grooves of some prior art roadway markers. This translates into better roadway surface attachment. Further, rather than the teeth 21 created where the grooves meet being rounded, the teeth 21 are pointed, making them sharp. Also, the pointed teeth project away from the leading side 18 of the roadway marker, i.e., toward the trailing side 16. This is created by creating a curvature that rises faster in the front (i.e., on the leading side) and falls slower in the back (i.e., on the trailing side). The sharp teeth 21 and their projection direction greatly improve the roadway holding power of the roadway marker 11. More specifically, the action of traffic causes the roadway marker to pull away from the adhesive that attaches the marker to a roadway. As the roadway marker is pulled away, the adhesive tries to elongate. The pointed teeth lock the adhesive into the base to improve adhesive performance.

The raised rumble portion 15 extends upwardly from the base area 13 beginning where the wing 20 ends. The raised rumble portion 15 extends the entire length of the roadway marker 11 as measured along the centerline A—A. The leading side 18 of the raised rumble portion 15 includes an inclined surface 23. Located at the top of the inclined surface is a flat ridge 25. The ridge terminates at a concave scalloped surface 27 that flares downwardly to the relatively thin trailing side 16 of the roadway marker 11.

The primary function of the scalloped surface 27 is to reduce the weight of the roadway marker to a minimum without sacrificing structural integrity. Thus it will be appreciated that the exact shape of the surface is not critical. Although the exact specifications of the curvature are not crucial, preferably, the average radius of curvature of the recess is substantially less than the radius of curvature of a typical automobile tire. This prevents an automobile tire from seating into the recess 25 after the tire passes over the raised rumble portion of the roadway marker 11. In one embodiment of the invention, the radius of curvature of the recess area is about four inches. The preferred range is two inches to ten inches.

Located along the upper edge of the inclined surface 23 is a lip 29. Located between the lip 29 and the wing 20 is a strip of reflective tape 31. The strip of reflective tape 31 provides a visual cue to roadway traffic. The lip 29 provides protection for the reflective tape strip 31 from abrasive contact with an automobile tire. In one preferred embodiment, the angle of inclination of the inclined surface 23 and, thus, the angle of inclination of the reflective tape strip with respect to the plane of the base 13 is in the 70° to 80° range. It has been found that this preferred angle of inclination range is well suited to reflecting incident light from automobile headlights back to a driver, even though angles lying in the 60° to 90° range may be acceptable in some environments. The wing 20 provides protection for the reflective strips 23 from any adhesive that might ooze out. If adhesive comes in contact with the adhesive strips, the night reflective properties of the strips can be greatly reduced. In this regard, it should be noted that the reflective strips provide motorists guidance during the day as well as at night. More specifically, when the raised rumble portion 15 is installed perpendicular to the direction of traffic, the reflective strips provide visual cues during daytime as well as nighttime hours.

Because a roadway marker 11 formed in accordance with this invention has a constant cross section, embodiments of the present invention can be manufactured by extrusion.

That is, embodiments of the invention can be formed by extruding a suitable plastic (or metal) through a die having a shape corresponding to the desired cross section configuration. The extrudate is then cured and hardened. The manufacture of roadway markers using an extrusion method greatly decreases the cost of such markers. Moreover, an extension method allows the roadway markers of the present invention to be easily manufactured in varying lengths, preferably with orthogonal end cuts. This allows embodiments of the invention to be used as "rumble" strips as well as spaced-apart roadway markers. The continuous nature of the base allows less adhesive to be used to create a strong bond when compared to bases that are interrupted by hollow regions, such as that described in the Oplt et al. patent referenced above. Adhesive tends to ooze into the hollows of Oplt et al. bases, reducing adhesive effectiveness.

While a preferred embodiment of the invention has been illustrated and described, it will be appreciated that, within the scope of the appended claims, various changes can be made therein without departing from the spirit and scope of the invention. Thus, it is to be understood that within the scope of the appended claims the invention can be practiced otherwise than as specifically described herein.

The embodiments of the invention in which an exclusive property or privilege is claimed are defined as follows:

1. An extruded, nonmetallic, one-way roadway marker having a base area for attachment to a roadway surface and a raised rumble portion, said base area having a plurality of parallel adjacent grooves, said grooves having an arcuate cross section, said grooves lying parallel to a centerline, said base area of substantially rectangular shape, said rectangular shape defined in part by a gripping edge lying parallel to said centerline located on one side of said roadway marker and a wing located on the other side of said roadway marker, said gripping edge curving downwardly from said base area, said raised rumble portion extending upwardly from said base area, said raised rumble portion including an inclined surface extending upwardly from the inward end of said wing, said inclined surface terminating in a ridge, said raised rumble portion including a region tapering from said ridge toward said gripping edge, said raised rumble portion having a constant cross section along at least a substantial portion of the entire length of said centerline, and a strip of reflective tape mounted on said inclined surface.

2. The one-way roadway marker of claim 1, wherein said raised rumble portion includes an overhanging lip located along the upper edge of said inclined surface.

3. The one-way roadway marker of claim 1, wherein said tapered region of said raised rumble portion is scalloped to form a recess.

4. The one-way roadway marker of claim 3, wherein said raised rumble portion includes an overhanging lip located along the upper edge of said inclined surface.

5. The one-way roadway marker of claim 3, wherein said recess has a radius of curvature between two inches and ten inches.

6. The one-way roadway marker of claim 5, wherein said raised rumble portion includes an overhanging lip located along the upper edge of said inclined surface.

7. The one-way roadway marker of claim 1, wherein said inclined surface forms an angle lying between 70° and 80° with the plane defined by said base area.

8. The one-way roadway marker of claim 7, wherein said raised rumble portion includes an overhanging lip located along the upper edge of said inclined surface.

9. The one-way roadway marker of claim 7, wherein said tapered region of said raised rumble portion is scalloped to form a recess.

10. The one-way roadway marker of claim 9, wherein said raised rumble portion includes an overhanging lip located along the upper edge of said inclined surface.

11. The one-way roadway marker of claim 9, wherein said recess has a radius of curvature between two inches and ten inches.

12. The one-way roadway marker of claim 11, wherein said raised rumble portion includes an overhanging lip located along the upper edge of said inclined surface.

13. The one-way roadway marker of claim 1, 2, 3, 4, 5, 6, 7, 8, 9, 10, 11 or 12, wherein said grooves join one another and define sharp teeth.

14. The one-way roadway marker of claim 13, wherein said sharp teeth project away from the side of said roadway marker containing said inclined surface.

15. An extruded, nonmetallic, one-way roadway marker having a base area for attachment to a roadway surface and a raised rumble portion, said base area having a plurality of parallel adjacent grooves, said grooves lying parallel to a centerline, said base area of substantially rectangular shape, said rectangular shape defined in part by a rigid gripping edge lying parallel to said centerline located on one side of said roadway marker and a wing located on the other side of said roadway marker, said rigid gripping edge curving downwardly from said base area, said raised rumble portion extending upwardly from said base area, said raised rumble portion including an inclined surface extending upwardly from the inward end of said wing, said inclined surface terminating in a ridge, said raised rumble portion including a region tapering from said ridge toward said gripping edge, said tapered region of said raised rumble portion being scalloped across its entire length to form a recess having a radius of curvature between two and ten inches, said raised rumble portion having a constant cross section along the entire length of said centerline, and a strip of reflective tape mounted on said inclined surface.

16. The one-way roadway marker of claim 15, wherein said raised rumble portion includes an overhanging lip located along the upper edge of said inclined surface.

17. The one-way roadway marker of claim 15, wherein said inclined surface forms an angle lying between 70° and 80° with the plane defined by said base area.

18. The one-way roadway marker of claim 17, wherein said raised rumble portion includes an overhanging lip located along the upper edge of said inclined surface.

* * * * *